US008549692B2

(12) United States Patent
Befve et al.

(10) Patent No.: US 8,549,692 B2
(45) Date of Patent: Oct. 8, 2013

(54) BRUSH FOR APPLYING A COSMETIC COMPOSITION AND HAVING SYNTHETIC HAIRS

(75) Inventors: Denis Befve, Arras (FR); Michel Fontaine, Paris (FR)

(73) Assignee: L'Oreal, Paris (FR)

( * ) Notice: Subject to any disclaimer, the term of this patent is extended or adjusted under 35 U.S.C. 154(b) by 61 days.

(21) Appl. No.: 13/002,834

(22) PCT Filed: Jul. 7, 2009

(86) PCT No.: PCT/FR2009/051347

§ 371 (c)(1), (2), (4) Date: Apr. 6, 2011

(87) PCT Pub. No.: WO2010/004207

PCT Pub. Date: Jan. 14, 2010

(65) Prior Publication Data

US 2011/0185528 A1 Aug. 4, 2011

Related U.S. Application Data

(60) Provisional application No. 61/091,911, filed on Aug. 26, 2008.

(30) Foreign Application Priority Data

Jul. 9, 2008 (FR) ..... 08 54676

(51) Int. Cl.
*A46B 17/00* (2006.01)

(52) U.S. Cl.
USPC ..... 15/160; 15/22.1; 15/DIG. 5; 15/207.2

(58) Field of Classification Search
USPC ..... 15/159.1, 160, 191.1, 207.2, DIG. 5
See application file for complete search history.

(56) References Cited

U.S. PATENT DOCUMENTS

| | | | | |
|---|---|---|---|---|
| 5,588,447 | A * | 12/1996 | Gueret | 132/200 |
| 2006/0123576 | A1 | 6/2006 | Howard | |
| 2006/0248669 | A1 | 11/2006 | Dovellos | |
| 2007/0271718 | A1 | 11/2007 | Hettes | |
| 2008/0141479 | A1 | 6/2008 | Mink | |
| 2009/0013489 | A1 * | 1/2009 | Binet et al. | 15/167.1 |

* cited by examiner

*Primary Examiner* — Shay Karls
(74) *Attorney, Agent, or Firm* — Novak Druce Connolly Bove + Quigg LLP

(57) ABSTRACT

A brush for applying a powdered cosmetic composition, comprising:

a tuft of synthetic hairs comprising at least two groups of hairs having, at their free ends, cross-sections of different surface area; and a handle supporting the tuft of hairs from a connecting portion of the hairs, characterized in that the groups of hairs have, in cross-section, the same surface area along their connecting portion.

12 Claims, 1 Drawing Sheet

BRUSH FOR APPLYING A COSMETIC COMPOSITION AND HAVING SYNTHETIC HAIRS

CROSS-REFERENCES TO RELATED APPLICATIONS

This application is a national phase of PCT/FR2009/051347, filed on Jul. 7, 2009 which claims priority to FR 0854676 filed Jul. 9, 2008 and to US 61/091911, filed Aug. 26, 2008, the entire contents of all are hereby incorporated by reference.

BACKGROUND OF THE INVENTION

1. Field of the Invention

The present invention relates to a brush for applying a powdered cosmetic composition, of the type comprising:

a tuft of synthetic hairs comprising at least two groups of hairs having, at their free ends, cross-sections of different surface area; and a handle supporting the tuft of hairs from a connecting portion of the hairs.

Such brushes are used in particular for picking up and applying to the skin powdered cosmetic compositions which may or may not be compacted, such as eyeshadows, loose powders or blushers.

2. Description of Related Art

The tuft of hairs on these brushes is generally made from a natural material, such as natural silks, or animal hair, such as squirrel hair, boar hair or goat hair.

The use of natural materials to produce the brushes considerably increases the cost of manufacture of the brush.

It is known to use synthetic hairs to form the tufts of brushes. In order to reproduce in the best possible manner the mechanical properties of brushes formed with natural hairs, it is known to form the tuft of hairs from a mixture of synthetic hairs having different cross-sections.

Such a brush is described for example in the document US 2007/0151061. Such brushes are difficult to manufacture since the hairs of different cross-section are not easily distributed in a homogeneous manner over the entire cross-section of the tuft when the hairs are mixed.

BRIEF SUMMARY OF THE INVENTION

The object of the invention is therefore to make it possible to provide a brush comprising synthetic hairs which reproduces in the best possible manner the properties of a brush comprising natural hairs, the manufacture of said brush being simplified, the mixing of hairs being easy to carry out.

To this end, the invention relates to a brush of the aforementioned type, characterized in that the groups of hairs have, in cross-section, the same surface area along their connecting portion.

According to particular embodiments, the brush comprises one or more of the following features:

one of the groups of hairs consists of hairs that are tapered as far as their free end only on an end portion;

the tapered hairs are tapered over a length of between 10% and 50% of the length of the free strand;

the ratio of the surface areas of the cross-sections of the tapered hairs between the two ends of the hair is between 20 and 50;

one of the groups of hairs consists of hairs that have a constant cross-section along their entire length;

the hairs having the smallest surface area of the cross-section at the free end have a length of the free strand greater than that of the hairs having the largest surface area of the cross-section at the free end;

the hairs having the smallest surface area of the cross-section at the free end have a length of the free strand smaller than that of the hairs having the largest surface area of the cross-section at the free end;

the hairs of the two groups have, along their free strand, a difference in length of between 1% and 20% of the length of the longest hairs;

the cross-section of the hairs along their connecting portion is between 50 and 150 microns; and the hairs having the smallest surface area of the cross-section at the free end represent preferably between 50% and 95% of the total number of hairs of the tuft.

The invention also relates to a method for manufacturing a brush for applying a powdered cosmetic composition, comprising:

a step of providing a first group of synthetic hairs;

a step of providing a second group of synthetic hairs, the hairs of the first and second groups having cross-sections of different surface area at a free end and cross-sections of the same surface area along a connecting portion;

a step of mixing the hairs of the two groups of hairs; and a step of connecting the mixed hairs along their connecting portion so as to form a tuft at the end of a handle.

BRIEF DESCRIPTIONS OF THE SEVERAL VIEWS OF THE DRAWINGS

The invention will be better understood on reading the following description which is given solely by way of example and with reference to the drawings, in which.

DETAILED DESCRIPTION OF THE INVENTION

Figure 1:
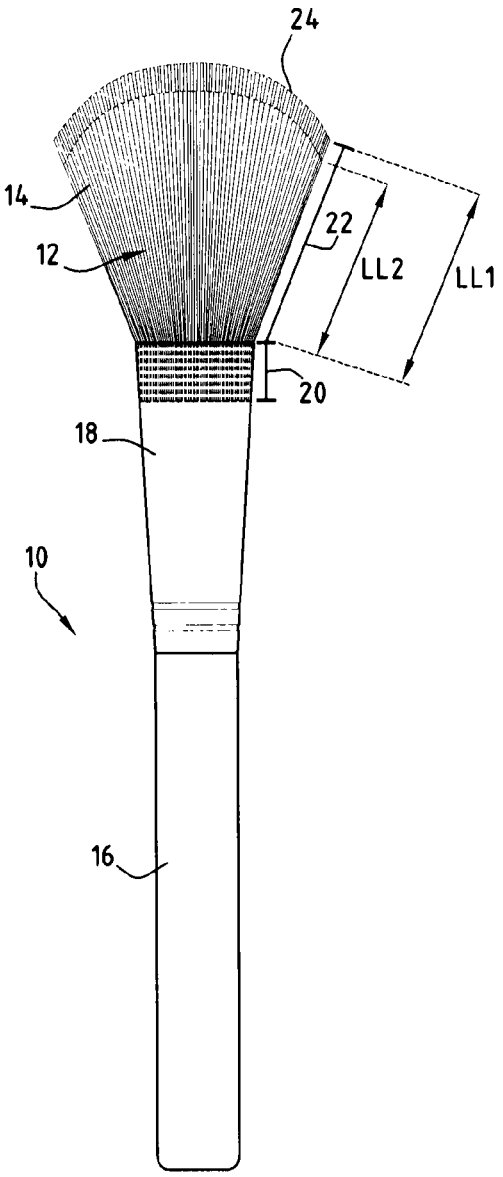
FIG. 1 is a view in elevation of a brush according to the invention.

The brush 10 according to the invention comprises a tuft 12 of hairs 14 held at the end of a handle 16 by a collar 18.

The handle 16 is formed of an elongate body, for example a profiled wooden rod. The collar 18 is formed of a metal fitting which encircles one end of the handle 16 and grasps a connecting portion, denoted 20, of each of the hairs 14 of the tuft.

All the connecting portions 20 of the hairs are clamped against one another inside the collar, thus ensuring the hold and cohesion of the tuft.

The connecting portions of the hairs 14 extend beyond the collar 20 so as to form in each case a free strand 22 which ends at a free end 24 of the hair.

Beyond the collar 20, all of the hairs 14 extend generally parallel to one another along the axis of the handle 16 or they diverge slightly away from one another in the direction of their free ends 24 so as to form a generally frustoconical tuft.

The end of the tuft 12 is for example curved, thus delimiting a convex surface. As a variant, this end is planar.

The hairs 14 are synthetic hairs, obtained by the extrusion and drawing of a polymer. For example, the hairs are made from polybutylene terephthalate (PBT) or polyamide.

Advantageously, all the hairs 14 have the same cross-section along their connecting portion 20. These hairs advantageously have a circular cross-section and then all have the same diameter. The diameter thereof is advantageously between 50 microns and 150 microns, or better still between 70 microns and 110 microns.

The tuft 12 comprises at least two groups of hairs having cross-sections of different surface area at their free ends 24. Thus, a first group comprises hairs having a cross-section at the free end 24 that has a surface area smaller than that of the hairs of larger cross-section contained in the second group.

Figure 2:
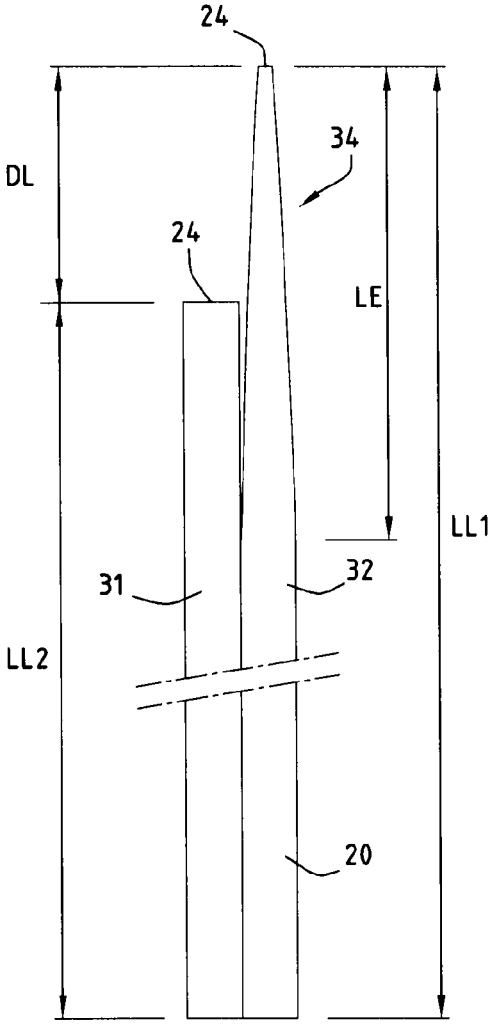
FIG. 2 is an enlarged view of a set of hairs of the brush of FIG. 1.

Thus, for example, and as shown in FIG. 2, a first group of hairs 31 is formed of hairs having a constant cross-section, whereas the second group of hairs 32 is formed of hairs having an end section, denoted 34, that is tapered, the hairs of the first and second groups having the same cross-section along their connecting portion 20, and more generally along their entire length outside the tapered portions.

Preferably, the hairs 31 and 32 are formed from the same fibre, in particular having a circular cross-section, and therefore consist of the same material and strictly have the same cross-section along their connecting portion 20.

The non-tapered hairs 31 have, at their end 24, a sectional plane that extends generally perpendicular to the axis of the hair.

The hairs 32 have on their tapered end portion 34 a cross-section that gradually decreases as far as the end 24. The change in diameter takes place continuously and preferably linearly along the length of the tapered portion 34 from the diameter of the retaining portion 20 to a minimum diameter located at the end 24.

The change in the cross-sectional surface area of the hairs having a tapered end, along the length of the tapered portions 34, is between 1/20 and 1/50, that is to say that the ratio of the surface area of the maximum cross-section of the hair to the surface area of the cross-section of the hair at its free end 24 is between 20 and 50. This ratio is preferably between 30 and 40.

Thus, the diameter of the cross-section of the hairs 32 at the free end 24 is advantageously between 5 microns and 30 microns, better still between 10 microns and 20 microns, and preferably between 12 microns and 17 microns.

The length LE of the tapered portion 34 is between 0.3 centimeter and 3 centimeters, better still between 0.5 centimeter and 1.5 centimeter, and preferably between 0.8 and 1.2 centimeters.

The tapered portion 34 extends over between 10% and 50% of the total length, denoted LL1, of the free strand 22 of the hairs 32, better still between 10% and 40% and preferably between 25% and 35%.

This length LL1 of the free strand 22 is between 0.5 centimeter and 7 centimeters, better still between 1 centimeter and 5 centimeters, and preferably between 3 and 4 centimeters.

The ratio between the number of non-tapered hairs 31 and the number of tapered hairs 32 is such that the tuft comprises mostly tapered hairs. Thus, the tapered hairs represent preferably between 50% and 95% of the total number of hairs of the tuft, better still between 70% and 95%, and preferably between 75% and 85%.

The tuft comprises a total number of hairs of between 25 000 and 75 000, and for example around 50 000.

The tapered portion 24 of the hairs 32 is preferably obtained by chemically treating a hair of constant cross-section. This treatment takes place for example by dipping only the portion to be tapered into an acid bath. The reduction in diameter of the hair that is obtained along the tapered portion is directly proportional to the residence time of the portion of the hair in the acid bath.

Thus, in order to obtain a frustoconical tapered portion, the hair is dipped perpendicular to the surface of the acid bath. It is introduced into the bath and removed from the bath at a constant speed of displacement, leading to a continuous and linear change in the cross-section of the hair.

Advantageously, the tapered hairs have, as shown in FIGS. 1 and 2, a length of the free strand LL1 of the tapered hair 32 that is greater than the length, denoted LL2, of the free strand of the non-tapered hairs 31. Thus, the free ends of the tapered hairs 32 protrude beyond the free ends of the non-tapered hairs 31.

Preferably, the different in length, denoted DL, between the two groups of hairs 31 and 32 is between 0.1 centimeter and 1 centimeter, better still between 0.2 centimeter and 0.7 centimeter, and preferably between 0.3 centimeter and 0.5 centimeter, or even between 0.3 centimeter and 0.4 centimeter.

Preferably, the difference in length of the hairs is between 1% and 20% of the longest hairs, better still between 5% and 15% and preferably between 8% and 12%.

With such a mixture of hairs having different cross-sections at their free end, some hairs being tapered in particular, a particularly pleasing contact with the skin is obtained which allows a satisfactory application of the cosmetic composition. Such a brush, due to the presence of the hairs having a large diameter at the end, is also particularly effective for picking up the cosmetic composition from its storage container.

The brush can be easily manufactured since it is formed of hairs which have the same cross-section along their connecting portion 20, and in particular over a substantial part of their length.

To manufacture the brush, the hairs of the first group having a constant cross-section and the hairs of the second group having a tapered end are each manufactured separately. They are then mixed in a vibrating funnel which ensures a homogeneous mixing of the hairs. Since all the hairs have the same cross-section along most of their length, the rheological mixing takes place easily and homogeneously. The connection of the mixed hairs by the collar at the end of the handle takes place in a manner known per se, by compressing the hairs against one another and crimping the collar.

In the embodiment envisaged here, the tuft of the brush comprises hairs that have a constant cross-section and hairs that are tapered at their free end. As a variant, both groups of hairs are tapered at their free end, but the degree of tapering is different from one group to the other, the surface areas of the cross-sections of the free ends of the hairs being different from one group to the other, whereas the cross-sectional surface areas thereof along the connecting portion are identical for the two groups of hairs.

By way of example, a brush having the following characteristics is particularly suitable for cosmetic applications.

LL1=40 mm
LL2=37 mm
LE=10 mm
diameter of the hairs: 70 μm
number of hairs: around 27 000
ratio between tapered/non-tapered hairs: 70/30
composition of the hairs (by weight)

| | |
|---|---|
| TALC | 30.9400 |
| TRIISOCETYL CITRATE | 0.0975 |
| DEODORIZED ISODECYL NEOPENTANOATE | 4.0500 |
| TITANIUM OXIDE | 2.0000 |
| YELLOW IRON OXIDE | 3.5200 |

-continued

| | |
|---|---|
| BROWN/YELLOW IRON OXIDES (75/25) | 2.0400 |
| BLACK IRON OXIDE | 0.9000 |
| MICA (CI: 77019) (SIZE: 8 MICRONS) | 10.0000 |
| MIXTURE OF METHYL, ETHYL, PROPYL, BUTYL, ISOBUTYL P-HYDROXYBENZOATES, PHENOXY-2 ETHANOL | 0.6000 |
| MICA | 20.0000 |
| NYLON 12 POWDER | 20.0000 |
| POLYDIMETHYLSILOXANE (VISCOSITY: 10 CST) | 1.2266 |
| MIXTURE OF POLYDIMETHYLSILOXANE/ TRIMETHYLSILOXYSILICATE in particular DOW CORNING 593 FLUID from DOW CORNING | 0.3861 |
| POLYMETHYLCETYL DIMETHYLSILOXANE (MW: 900-VISCOSITY: 15-25 CST), generally known as silicone wax | 0.2399 |
| MAGNESIUM STEARATE | 4.0000 |

Throughout the above text, the cross-sections are advantageously taken transversely to the local axis of the hair at the site of the cross-section.

Furthermore, as shown in FIG. 2, each hair 32 has, along the entire length of the tapered portion 34, a cross-section relative to the axis of the hair 32 which has a contour that is homothetic to the contour of the cross-section of the hair 32 in the retaining portion.

Thus, if the retaining portion 20 has a circular cross-section of diameter D1, the tapered portion 34 has a likewise circular cross-section of diameter D2 which is smaller than D1 and decreases towards the free end 24.

The invention claimed is:

1. A brush for applying a powdered cosmetic composition, comprising:

a tuft of synthetic hairs comprising at least two groups of hairs; wherein the at least two groups of hairs comprise at least a first group of hairs and at least a second group of hairs, each hair of the first group of hairs has at its free end a cross-section having a surface area which is different of the surface area of the cross-section of the free end of each hair of a second group of hair;

each hair of the first group of hair and each hair of the second group of hair have, in cross-section, the same surface area along their connecting portion; and a handle supporting the tuft of hairs from a connecting portion of the hairs, wherein the handle is formed of an elongated body along an axis, the tuft extending substantially axially with regards to the axis of the elongated body; and wherein the groups of hairs have, in cross-section, the same surface area along their connecting portion.

2. The brush according to claim 1, wherein one of the groups of hairs consists of hairs that are tapered as far as their free end only on an end portion, giving tapered hairs.

3. The brush according to claim 2, wherein the tapered hairs are tapered over a tapered lengthof between 10% and 50% of a free strand length.

4. The brush according to claim 2, wherein a ratio of the surface areas of cross-sections of the tapered hairs between the two ends of the hair is between 20 and 50.

5. The brush according to claim 2 wherein the cross-section of each hair of the other group has, along the entire length of an end portion, a contour that is homothetic to a contour of the cross-section of the hair in the connecting portion.

6. The brush according to claim 1 wherein one of the groups of hairs consists of hairs that have a constant cross-section along their entire length.

7. The brush according to claim 1 wherein the hairs having the smallest surface area of the cross-section at the free end have a free strand length greater than that of the hairs having the largest surface area of the cross-section at the free end.

8. The brush according to claim 7, wherein the hairs of the two groups have, along their free strand, a difference in length of between 1% and 20% of the length of the longest hairs.

9. The brush according to claim 1 wherein the cross-section of the hairs along their connecting portion is between 50 and 150 microns.

10. The brush according to claim 1 wherein the hairs having the smallest surface area of the cross-section at the free end represent between 50% and 95% of the total number of hairs of the tuft.

11. A method for manufacturing a brush for applying a powdered cosmetic composition according to claim 1, comprising:

mixing a first group of synthetic hairs and a second group of synthetic hairs wherein each hair of the hairs of the first and second groups having cross-sections of different surface area at a free end and cross-sections of the same surface area along a connecting portion, to give mixed hairs; and connecting the mixed hairs along their connecting portion so as to form a tuft at an end of a handle.

12. The brush for applying a powdered cosmetic composition according to claim 1, wherein the brush comprises a single tuft.

* * * * *